US011596205B2

(12) United States Patent
Klein

(10) Patent No.: US 11,596,205 B2
(45) Date of Patent: Mar. 7, 2023

(54) TETHERED ANCHOR POINT FOR FOOTWEAR LACE ELEMENT

(71) Applicant: NIKE, Inc., Beaverton, OR (US)

(72) Inventor: Ross Klein, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 9 days.

(21) Appl. No.: 16/921,658

(22) Filed: Jul. 6, 2020

(65) Prior Publication Data

US 2020/0329820 A1 Oct. 22, 2020

Related U.S. Application Data

(62) Division of application No. 15/297,917, filed on Oct. 19, 2016, now abandoned.

(60) Provisional application No. 62/243,482, filed on Oct. 19, 2015.

(51) Int. Cl.

| | |
|---|---|
| ***A43C 1/04*** | (2006.01) |
| ***A43B 23/02*** | (2006.01) |
| ***A43C 3/00*** | (2006.01) |
| ***A43C 1/00*** | (2006.01) |

(52) U.S. Cl.

CPC ..... *A43C 1/04* (2013.01); *A43B 23/0245* (2013.01); *A43B 23/0265* (2013.01); *A43C 1/00* (2013.01); *A43C 3/00* (2013.01)

(58) Field of Classification Search

CPC .... A43C 1/04; A43C 1/00; A43C 3/00; A43C 3/02; A43C 11/12; A43C 5/00; A43C 11/00; A43B 23/0245; A43B 23/0265; A43B 23/24; A43B 23/02; A43B 23/00

USPC ..... 36/50.1

See application file for complete search history.

(56) References Cited

U.S. PATENT DOCUMENTS

| | | | | |
|---|---|---|---|---|
| 1,505,430 A | | 8/1924 | Richard et al. | |
| 3,162,920 A | | 12/1964 | Durham | |
| 3,174,780 A | * | 3/1965 | Shapiro | F16G 11/146 403/210 |
| 4,058,049 A | | 11/1977 | Bech | |

(Continued)

FOREIGN PATENT DOCUMENTS

| | | |
|---|---|---|
| CN | 102821635 A | 12/2012 |
| CN | 103079418 A | 5/2013 |

(Continued)

OTHER PUBLICATIONS

"4 New 1/4" Eyelet Steel Cable / Rope Loop Guide Zinc Plated Galvanized Thimble", eBay, Seller: sutherbys, Available online at: <https://www.ebay.com/itm/4-New-1-4-Eyelet-Steel-Cable-Rope-Loop-Guide-Zinc-Plated-Galvanized-thimble-/161201806923>, Accessed on Sep. 2015, 3 pages.

(Continued)

*Primary Examiner* — F Griffin Hall

(74) *Attorney, Agent, or Firm* — Shook Hardy & Bacon, L.L.P.

(57) ABSTRACT

A tethered anchor point for a footwear lace element includes various elements. For example, the tethered anchor point includes a tensile strand that attaches to a portion of the footwear article. In addition, the tethered anchor point includes a tensile-strand reinforcement. The tensile-strand reinforcement provides a sliding surface against which the lace element of the footwear article may slide when the lace element is threaded through the tethered anchor point.

15 Claims, 7 Drawing Sheets

(56) References Cited

U.S. PATENT DOCUMENTS

| | | | | |
|---|---|---|---|---|
| 4,633,548 | A | 1/1987 | Siskind et al. | |
| 4,916,833 | A | 4/1990 | Nwoko | |
| 5,535,531 | A * | 7/1996 | Karabed | A43C 7/00 36/1 |
| 5,755,044 | A | 5/1998 | Veylupek | |
| 5,761,777 | A | 6/1998 | Leick | |
| 5,906,057 | A | 5/1999 | Borsoi | |
| 6,219,891 | B1 | 4/2001 | Maurer et al. | |
| 6,240,657 | B1 | 6/2001 | Weber et al. | |
| 6,568,103 | B2 | 5/2003 | Durocher | |
| 6,735,829 | B2 * | 5/2004 | Hsu | A43C 3/00 24/712.9 |
| 7,086,803 | B2 | 8/2006 | Ackerman et al. | |
| 7,591,050 | B2 | 9/2009 | Hammerslag | |
| 8,277,401 | B2 * | 10/2012 | Hammerslag | A43C 11/14 602/5 |
| 8,516,725 | B1 | 8/2013 | George | |
| 8,800,172 | B2 | 8/2014 | Dua et al. | |
| 8,800,173 | B2 | 8/2014 | Smith | |
| 9,681,705 | B2 * | 6/2017 | Trudel | A43C 11/165 |
| 9,918,865 | B2 * | 3/2018 | Nickel | A61F 5/028 |
| 10,702,409 | B2 * | 7/2020 | Burns | A61F 5/0102 |
| 2003/0066207 | A1 | 4/2003 | Gaither | |
| 2004/0181972 | A1 | 9/2004 | Csorba | |
| 2006/0075614 | A1 | 4/2006 | Chmelar | |
| 2009/0276981 | A1 * | 11/2009 | Thompson | B63B 21/04 24/115 R |
| 2012/0023778 | A1 | 2/2012 | Dojan et al. | |
| 2012/0198727 | A1 | 8/2012 | Long | |
| 2014/0196311 | A1 | 7/2014 | Follet et al. | |
| 2014/0196315 | A1 | 7/2014 | Beye et al. | |
| 2014/0259295 | A1 | 9/2014 | Guglielmo et al. | |
| 2014/0325873 | A1 | 11/2014 | Linth | |
| 2017/0105487 | A1 | 4/2017 | Klein | |

FOREIGN PATENT DOCUMENTS

| | | | |
|---|---|---|---|
| CN | 103167812 | A | 6/2013 |
| EP | 0717942 | A1 | 6/1996 |
| WO | 01/42682 | A1 | 6/2001 |

OTHER PUBLICATIONS

"Eyelets & Lacing", Hardware Elf, Available online at: <http://www.hardwareelf.com/elfeyelelsandlacing.jsp>, 2014, 3 pages.

"McRae Women's Poron XRD Met Guard Steel Toe Lace Up Boot MR47300", Backpacking gear outlet, Available online at: <http://www.backpackinggearoutlet.com/product/mcrae-industrial-mr47300-womens-pro-met-guard-steel-toe-hiker-blackgrey-6-w-us/, Accessed on Sep. 2015, 6 pages.

* cited by examiner

TETHERED ANCHOR POINT FOR FOOTWEAR LACE ELEMENT

CROSS-REFERENCE TO RELATED APPLICATIONS

This application is a divisional of U.S. application Ser. No. 15/297,917, filed Oct. 19, 2016. U.S. application Ser. No. 15/297,917 claims the benefit of U.S. Provisional Application No. 62/243,482 (filed Oct. 19, 2015). Each of the aforementioned applications is incorporated herein by reference in its entirety.

BRIEF SUMMARY

A tethered anchor point for a footwear lace element includes various elements. For example, the tethered anchor point includes a tensile strand that attaches to a portion of the footwear article. In addition, the tethered anchor point includes a tensile-strand reinforcement. The tensile-strand reinforcement provides a sliding surface against which the lace element of the footwear article may slide when the lace element is threaded through the tethered anchor point. Aspects of the technology are defined by the claims below, not this Brief Summary. A high-level overview of various aspects of the technology is provided in this section to introduce a selection of concepts that are further described below in the detailed description. This Brief Summary is not intended to identify key features or essential features of the claimed subject matter, nor is it intended to be used as an aid in isolation to determine the scope of the claimed subject matter.

BRIEF DESCRIPTION OF THE DRAWINGS

The present invention is described in detail herein with reference to the attached drawing figures, which are incorporated herein, wherein.

DETAILED DESCRIPTION

Figure 1A:
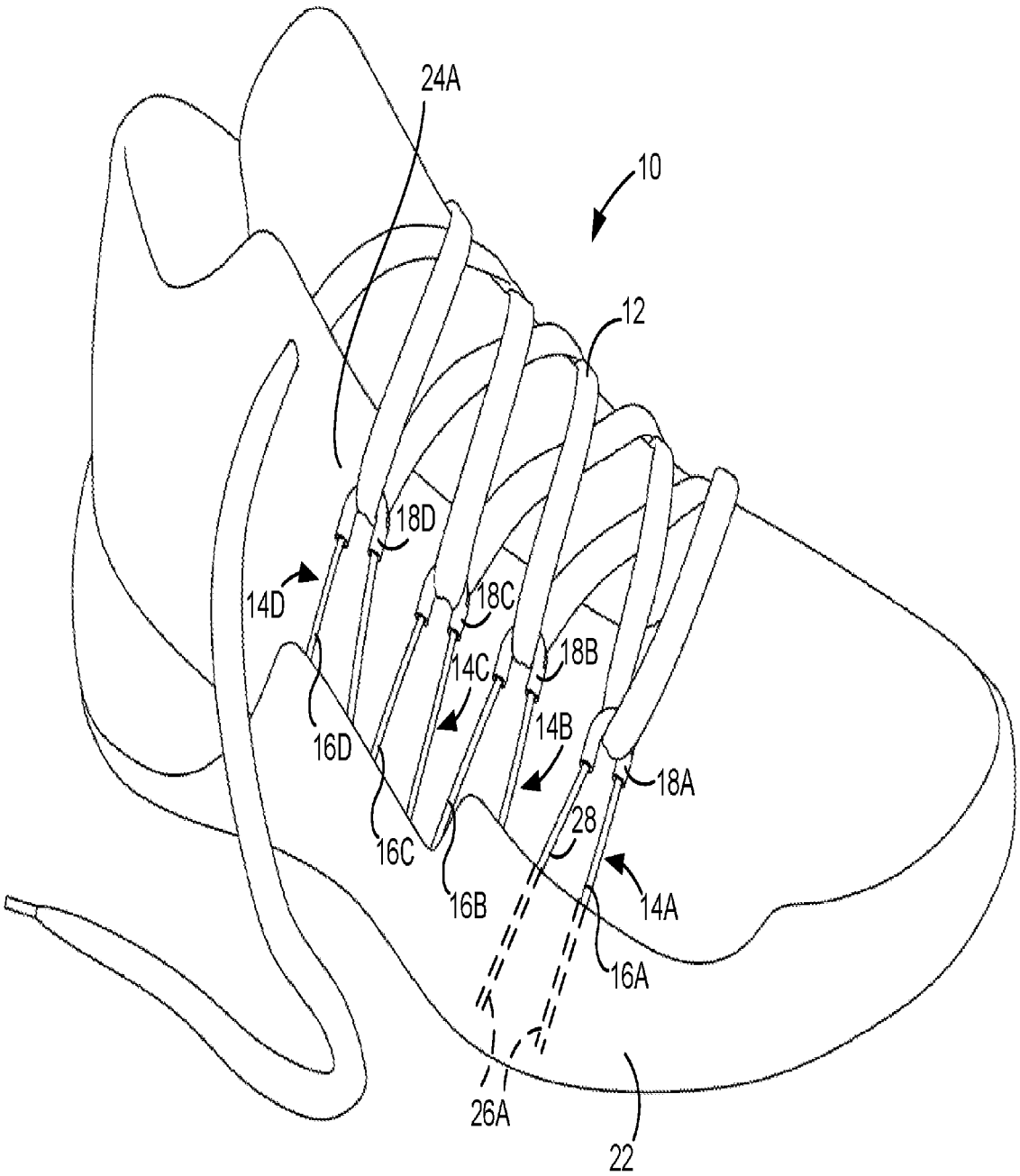
FIGS. 1A-1C each depicts a respective footwear article with tethered anchor points in accordance with an aspect hereof.

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by and is within the scope of the claims.

Footwear articles often include a lace element or other tensile strand that is used to form at least part of a foot-receiving enclosure or that is used to adjust a fit of the footwear article. In some instances, the lace element is threaded through one or more anchor points on the footwear article, which allows the lace element to sinuously extend from one part of the footwear article to another part of the footwear article. By applying tension to the lace element, one part of the footwear article can be drawn towards another part of the footwear article in order to tighten a fit. In addition, the fit can be loosened by releasing tension on, or untying, the lace element.

Exemplary Footwear with Tethered Anchor Points

An aspect of the present invention is directed to a tethered anchor point for a footwear lace element. For example, referring to FIG. 1A an exemplary footwear article 10 is illustrated that includes a lace element 12 threaded through a set of tethered anchor points 14A-D. Generally, each tethered anchor point includes a respective tensile strand 16A-D and a respective tensile-strand reinforcement 18A-D. In some aspects, the tensile-strand reinforcements 18A-D provide sliding surface with lower relative friction (as compared to the tensile strands 16A-D) for when the lace element 12 is slid or pulled across the tethered anchor points 14A-D under tension, such as when tightening the fit of the footwear article 10. In addition, the tensile-strand reinforcements 18A-D can help to reduce wear, abrasion, and the like on the tensile strands 16A-D that might arise from repeated tensioning (e.g., tying) and loosening (e.g., untying) of the lace element 12.

The term "tensile strand" refers to an elongate member generally having a length that is substantially greater than a width and a thickness. Some types of tensile strands include at least a portion that is flexible and non-rigid. A tensile strand may include various constructions of various types of material and may have the configuration of various filaments, fibers, yarns, threads, ropes, cables, wires, or extrudates. For example, a tensile strand may include an intertwining of smaller filaments or fibers that are woven, knitted, braided, or otherwise intertwined together. A tensile strand may also include various types of materials, such as rayon, nylon, polyester, polyacrylic, silk, cotton, carbon, carbon, glass, aramids (e.g., para-aramid fibers and meta-aramid fibers), ultra high molecular weight polyethylene (UHMW-PE), liquid crystal polymer, copper, aluminum, and steel.

Each tensile strand 16A-D is coupled to the footwear article 10. For example, a tensile strand may be coupled to the sole portion 22 of the footwear article 10, to the upper portion 24A of the footwear article, or to both the upper portion 24A and the sole portion 22 of the footwear article. In FIG. 1A the tensile strand 16A includes an attached portion 26A that is coupled between the upper portion 24A and the sole portion 22 and that is depicted in broken lines to illustrate at least part of the attached portion 26A being obscured from view. For instance, the attached portion 26A might be bonded directly to the sole portion 22 and/or directly to the upper portion 24A and layered between the sole portion 22 and the upper portion 24A. In FIG. 1A the tensile strand 16A includes two end portions 26B that are both coupled to the footwear article 10, thereby creating a looped portion (e.g., element 30 in FIG. 2B) that can be interlooped with the lace element 12. Each of the other tensile strands 16B-D may also include respective attached portion that are coupled between the sole 22 and the upper 24A and that is similar to the attached portions 26A.

The tensile strands may include various other coupling arrangements or mechanisms that attach the tensile strands to the footwear article. For example, referring to FIG. 1B each tensile strand includes end portions 26B that are coupled directly to the upper 24B. The end portions 26B may be attached to the upper 24B by various attachment mechanisms, such as by stitching, bonding, welding, and the like. As described with respect to element 16A in FIG. 1A, since both ends 26B are attached to the upper 24B, a loop is formed through which the lace strand 12 may be threaded. In FIG. 1C another exemplary aspect is illustrated in which at least a portion 26C of the tensile strands extend beneath an outer layer of the upper 24C. For instance, the portions 26C may pass through tubular structures or sheaths that are constructed into the upper 24C or that are affixed to the upper 24C. In other instance, the portions 26C may be retained beneath an overlay (e.g., thermoplastic polyurethane "TPU"). In addition, the portions 26C may pass between an outer layer of the upper and inner layer of the upper. Again, with both portions 26C attached, a loop is formed by the tensile strand that can threadably receive the lace element 12. In other aspects, a tensile strand may be integrally formed with the sole portion 22 through molding, co-molding, or some other co-forming process. Or the sole portion 22 may include a fiber-composite construction that allows for one or more fibers to extend away from the sole as the tensile strands.

Figure 1B:
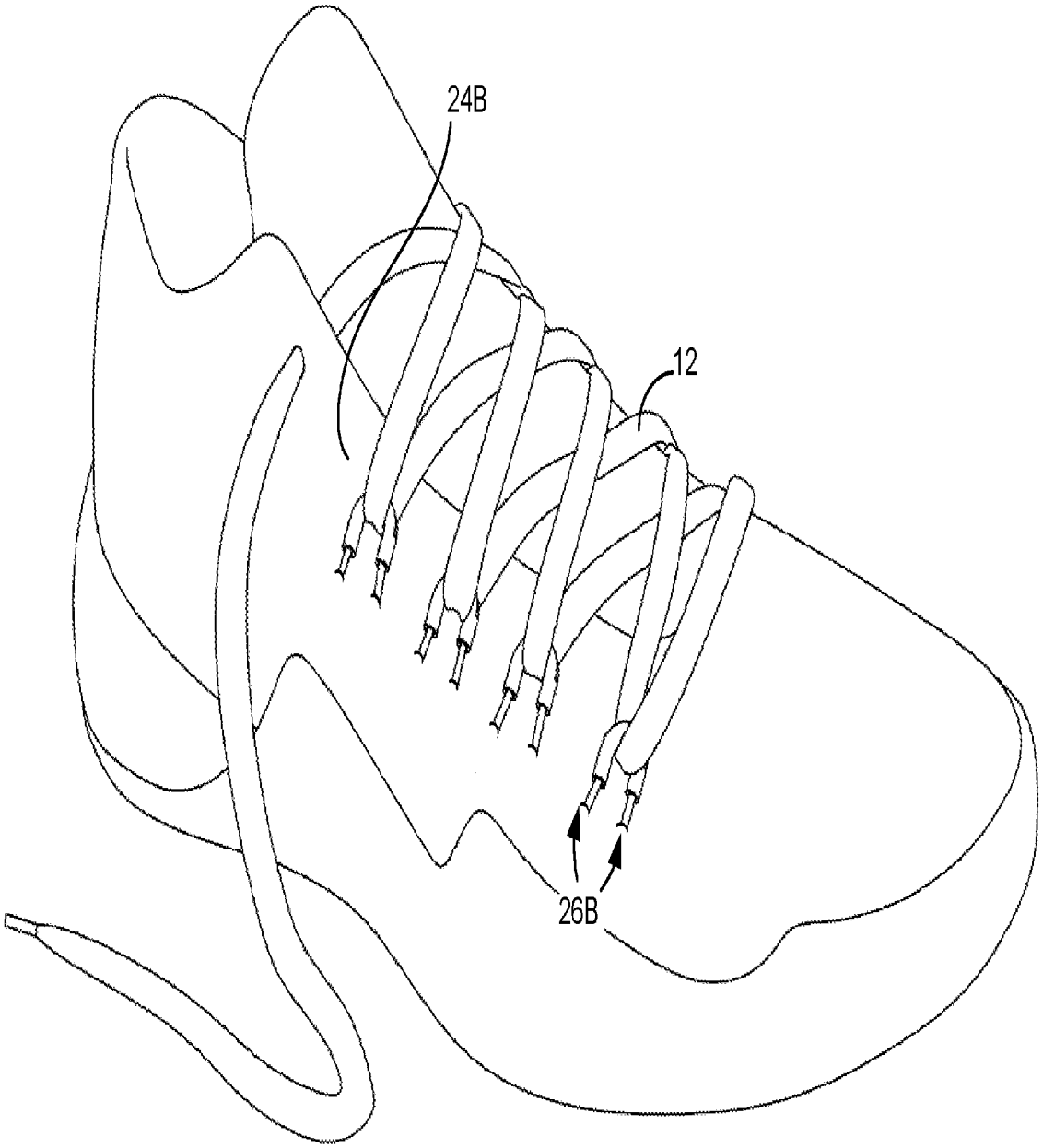
Figure 1C:
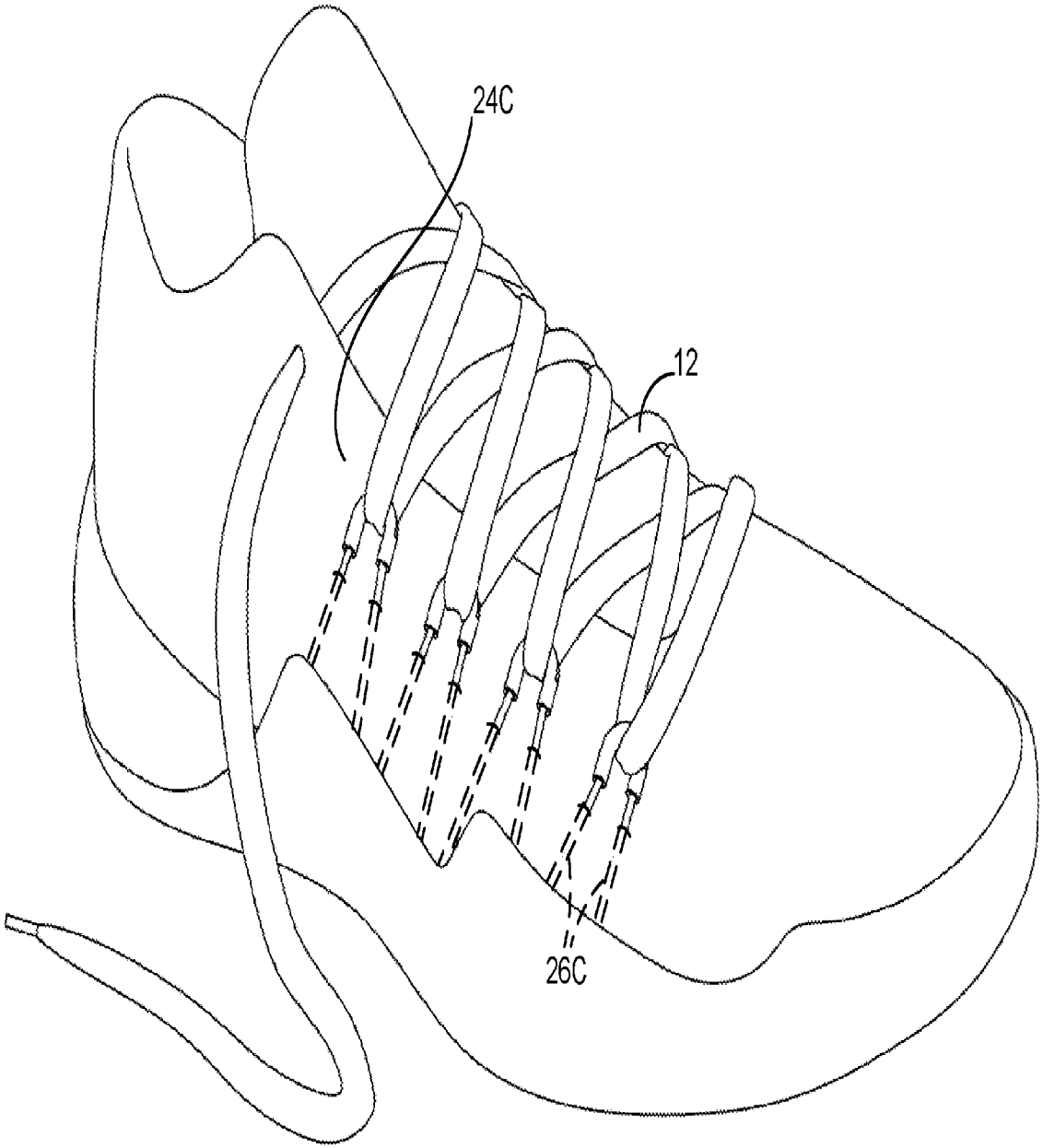

Referring generally to FIGS. 1A-C, each tensile strand (e.g., 16A-D) also includes a tethering portion that couples the attached ends (i.e., 26A-C) to a lace-interlooping portion. For example, in FIG. 1A the tensile strand 16A includes a tethering portion 28 that extends from the attached portions 26A and that transitions to a lace-interlooping portion. The lace-interlooping portion is at least partially enclosed by the tensile-strand reinforcement 18A and is obscured from view in FIG. 1A. These aspects will be described in more detail with respect to FIGS. 2A and 2B.

Exemplary Tethered Anchor Point

Figure 2A:
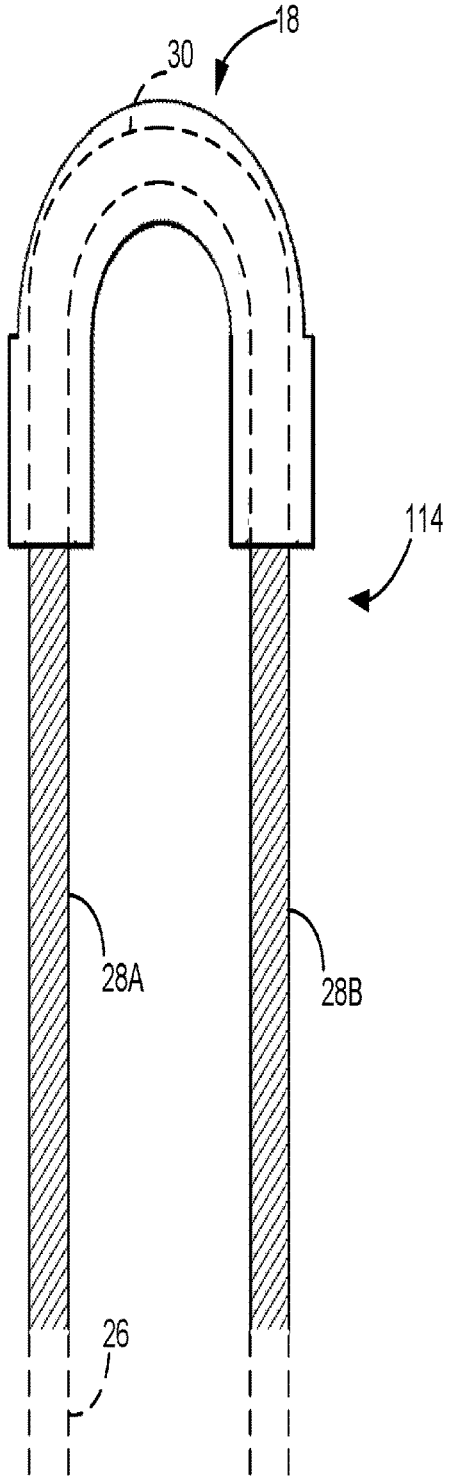
FIGS. 2A and 2B depict a tethered anchor point in accordance with an aspect hereof.
Figure 2B:
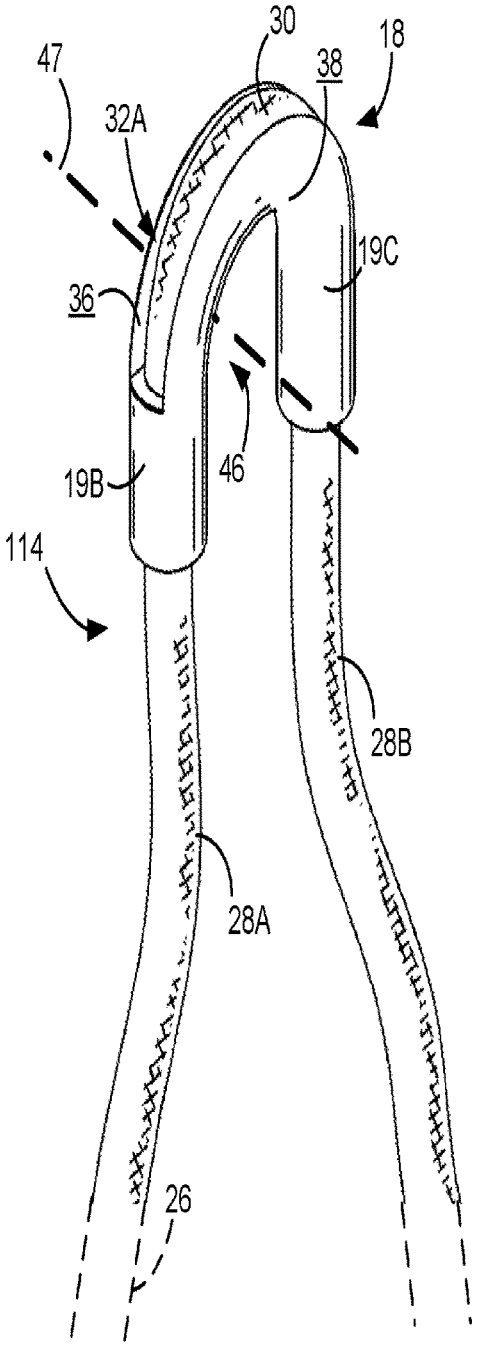

In FIGS. 2A and 2B illustrative views of a tethered anchor point 114 are provided. To aid in the explanation and the illustration, the tethered anchor point 114 is shown detached from a footwear article. But the description provided of the tethered anchor point 114 in FIGS. 2A and 2B also applies to the tethered anchor points (e.g., 14A-D) illustrated in FIGS. 1A-1C. For example, the end portion 26 of the tethered anchor point 114 may correspond to any of the attached end portions 26A-C described with respect to FIGS. 1A-1C, respectively.

In one aspect, the tethered anchor point 114 includes tethering portions 28A and 28B that extend away from the end portions 26 and that transitions into a looped portion 30. The looped portion 30 is depicted as a single continuous strand that extends from, and connects, one tethering portion 28A to the other tethering portions 28B. In aspects of the present invention, the looped portion 30 interloops with the lace element 12 when the lace element 12 is threaded through the tethered anchor points 14.

In FIGS. 1A-1C and 2A-2B, the tethered anchor points 14 and 114 also include tensile-strand reinforcements 18 and 18A-D coupled to respective loop portions 30 of the tensile strands. The tensile-strand reinforcement 18 includes a tubular sleeve structure having a hollow core or channel that receives the loop portion 30. In one aspect, hollow core or channel extends in a curved configuration (e.g., u-shaped or c-shaped) or bent configuration (e.g., v-shaped) that also forms a partially enclosed passageway through which the lace element 12 can be threaded. Among other things, the tensile-strand reinforcement 18 may provide a sliding surface with lower relative friction (as compared with the tensile strand) against which a lace element 12 may slide. In addition, the tensile-strand reinforcement 18 may reduce wear of the tensile strand that may be caused by sliding against the lacing element 12. The tensile-strand reinforcement 18 will be described in more detail with respect to FIGS. 3A-3F.

Referring now to FIGS. 3A-3F, various aspects of the tensile-strand reinforcement 18 will be described. The tensile-strand reinforcement 18 includes a channel 32A-C formed by a radial wall 34A-D. The radial wall 34A-D includes an internal surface 36 facing toward the channel 32A-C and an external surface 38 facing away from the channel 32A-C. In addition, the radial wall 34A-D at least partially circumscribes a central axis 40A-C of the channel that extends from one terminal end 42A of the channel 32A-C to an opposing terminal end 42B of the channel 32A-C. The channel 32A-C includes a bend 44 (FIG. 3A) between the one terminal end 42A and the opposing terminal end 42B, such that the central axis 40A-C of the channel extends along a path that bends at least about 180 degrees. However, in other aspects the path may extend less than 180 degrees, such as in a V-shape, or may extend more than 180 degrees, such as in a tear-drop shape or partial tear-drop shape.

In a further aspect, the external surface 38 of the radial wall located at the bend 44 of the channel radially extends at least partially around a lace passageway 46 through which a lace element 12 may be threaded. An axis 47 of the lace passageway 46 extends substantially perpendicular to the central axis 40 of the channel. Referring briefly back to FIG. 2B, the loop portion 30 is positioned in the channel and is at least partially circumscribed by the internal surface 36, and the axis 47 of lace passage 46 is oriented substantially perpendicular to the loop portion 30.

Figure 3A:
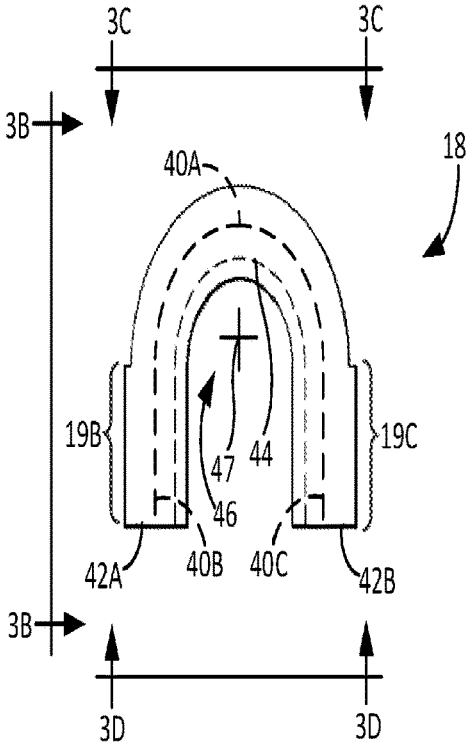
FIGS. 3A-3F each depicts a respective view of a tensile-strand reinforcement in accordance with an aspect hereof.
Figure 3B:
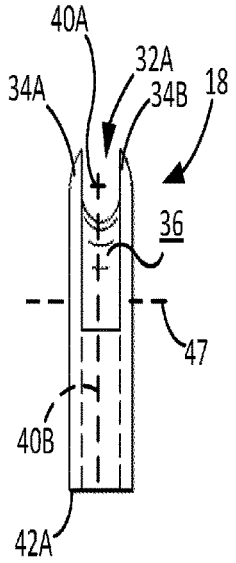
Figure 3C:
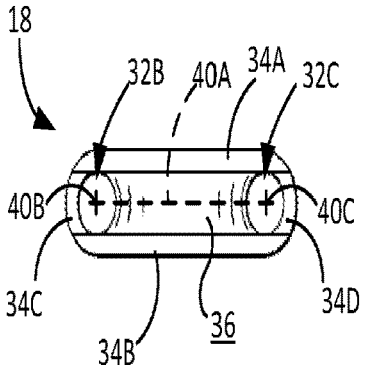
Figure 3D:
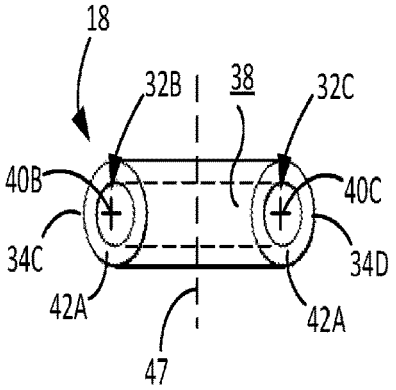
Figure 3E:
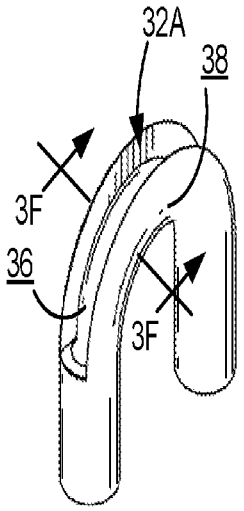

In a further aspect of the technology, the internal surface 36 of the radial wall completely circumscribes the central axis 40A-C at two or more portions of the channel 32A-C. For example, as depicted in FIG. 3D, end portions 42A and 42B include the radial walls 34C and 34D that completely circumscribe respective portions of the axis 40B and 40C. Furthermore, the two portions of channel 32B and 32C including the circumscribing radial wall 34C and 34D are separated by an open-sided channel portion 32A in which the internal surface only partially circumscribes the central axis 40A.

The radial wall 34A-D might be configured to include various structures. For example, in one aspect the tensile-strand reinforcement includes a first tubular structure 19B having a first axis 40B and a second tubular structure 19C having a second axis 40C. As depicted in FIGS. 2B and 3A, the first and second tubular structures 19B and 19C are positioned on opposing terminal ends of the tensile-strand reinforcement sleeve, and in a further aspect, the first axis and the second axis 40B and 40C are substantially parallel. In addition, the first tubular structure 19B and the second tubular structure 19C are coupled to each other by the open-sided channel 32A, which includes the radial wall 34A and 34B. The relative lengths of the tubular structures 19B and 19C and the open-sided channel 32A are depicted in the various figures for illustrative purposes only. Thus, in other aspect, the tubular structures 19B and 19C may be shorter or longer.

As previously described, the radial walls 34A and 34B include the internal surface 36 that faces toward the channel and that partially circumscribes the central axis 40A of the channel. In FIG. 3A, the tubular structures 19B and 19C and the channel 32A are integrally formed end-to-end, such that the axis 40A-C are axially aligned. FIG. 2B depicts the looped portion 30 of the tensile strand extending through both the first tubular structure 19A and the second tubular structure 19B and positioned in the channel 32A, such that the looped portion is at least partially circumscribed by the internal surface 36.

Figure 3F:
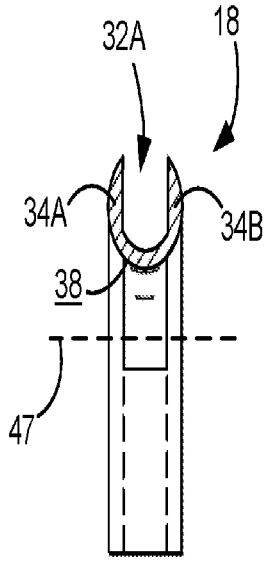

The tensile-strand reinforcement 18 includes various features that may provide a sliding surface for the lace element 12. For example, FIG. 3F illustrates a cross-sectional view of part of the open-sided channel 32A, taken along reference line 3F-3F in FIG. 3E. In one aspect, the external surface 38 of the radial wall 34A-B includes a convex-shaped surface topography, which curves outward as the external surface 38 extends in the direction of the lace passageway and from one portion 34A of the radial wall to the other portion 34B of the radial wall. In one aspect, this convex topography of the external surface helps to provide a sliding surface against which the lace element 12 may slide with reduced friction (relative to the tension strand). In addition, the tensile-strand reinforcement 18 may be constructed of various materials that provide a reduced-friction sliding surface. For example, the tensile-strand reinforcement 18 might be constructed of a metal having a friction-reducing finish. Or the tensile-strand reinforcement 18 may be constructed of a polymer having a hardness above a certain threshold.

The tensile-strand reinforcement 18 may be coupled to the strand using various techniques. For instance, the opposing ends (e.g., 26) of the tensile strand may both be threaded through a respective tubular structure by passing the ends through the open-sided channel 32A and out the respective terminal end 42A or 42B.

Alternative Configuration for Tensile-Strand Reinforcement

Figure 4A:
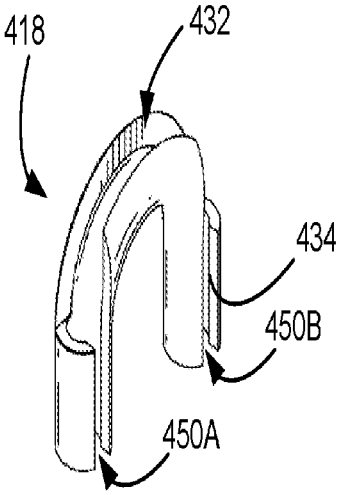
FIGS. 4A-4D each depict respective views of an alternative tensile-strand reinforcement in accordance with an aspect hereof.
Figure 4B:
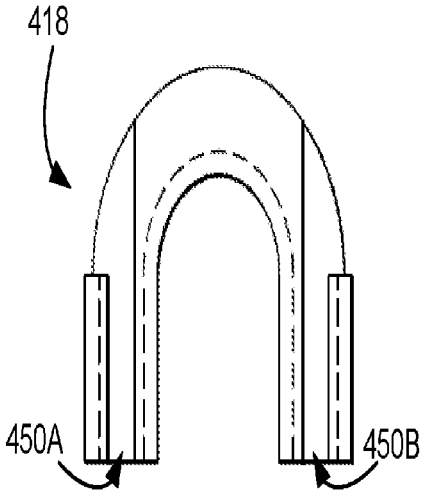
Figure 4C:
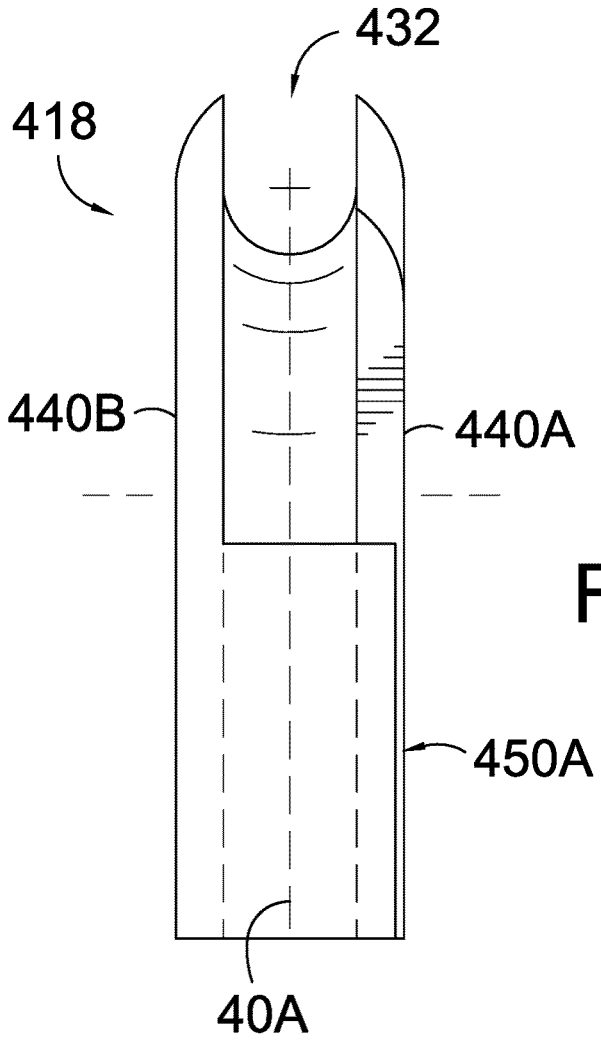
Figure 4D:
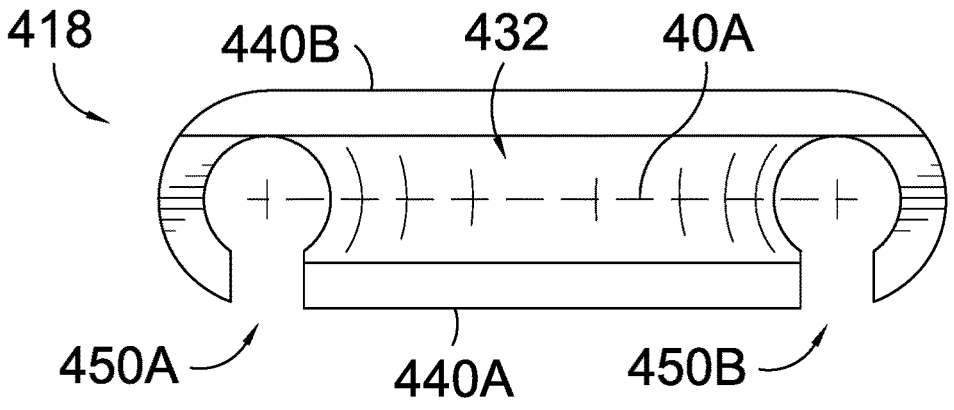

In an alternative aspect, portions of the radial wall are removed or omitted to form one or more slots for inserting the tensile strand. For example, FIGS. 4A and 4B illustrate one alternative aspect of a tensile-strand reinforcement 418 in which portions of the radial wall 434 have been removed to form slots 450A and 450B. The tensile-strand reinforcement 418 functions similarly to the tensile-strand reinforcement 18, such as by providing a sliding surface for the lace element and by helping to reinforce and protect the tensile strand. But the tensile strand may be passed through the slots 450A and 450B of the tensile-strand reinforcement 18 in order to position the tensile strand in the channel 432, as opposed to threading ends of the tensile strand through the tubular portions depicted in FIGS. 3A-3F. The slots 450A and 450B are depicted as substantially straight. But in other aspects, the slots may extend in a non-straight path, which may impeded the tensile strand from slipping out of the channel 432. In one aspect, the tensile strand reinforcement 418 can be affixed to a tensile strand after the attachment portion of the tensile strand has been coupled to a footwear article. Furthermore, FIGS. 4C and 4D provide additional views of the alternative tensile-strand reinforcement mechanism 418. As depicted in FIGS. 4C and 4D, a central axis 40A bisects the tensile-strand reinforcement mechanism 418 into a first side 440A and the second side 440B.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A tensile-strand reinforcement mechanism having a first side and a second side, the tensile-strand reinforcement mechanism comprising:

a channel having a radial wall with an internal surface facing toward the channel and an external surface facing away from the channel;

wherein the internal surface of the radial wall at least partially circumscribes a central axis of the channel that extends from a first terminal end of the channel to a second terminal end of the channel, wherein the central axis of the channel bisects the tensile-strand reinforcement mechanism into the first side and the second side;

wherein the channel includes a bend between the first terminal end and the second terminal end, such that the central axis of the channel extends along a path that bends at least about 180 degrees;

wherein the bend of the channel radially extends at least partially around a lace passageway; and wherein the channel includes two slots extending entirely through the radial wall from the external surface to the internal surface, wherein the two slots are each positioned entirely on the first side of the tensile-strand reinforcement mechanism.

2. The tensile-strand reinforcement mechanism of claim 1, wherein the two slots comprise a first slot opening to the first terminal end and a second slot opening to the second terminal end.

3. The tensile-strand reinforcement mechanism of claim 1, wherein each of the two slots is substantially straight.

4. The tensile-strand reinforcement mechanism of claim 1, wherein the two slots extend in a non-straight manner.

5. The tensile-strand reinforcement mechanism of claim 1, wherein the bend includes an open-sided portion that fluidly connects with the two slots.

6. The tensile-strand reinforcement mechanism of claim 1, wherein the lace passageway extends from the bend entirely to both the first terminal end and the second terminal end.

7. A tensile-strand reinforcement mechanism having a first side and a second side, the tensile-strand reinforcement mechanism comprising:

a first tubular structure having a first radial wall circumscribing a first axis, the first tubular structure comprising a first terminal end of the tensile-strand reinforcement mechanism and comprising a first slot extending entirely through the first radial wall from an external surface of the first radial wall to an internal surface of the first radial wall;

a second tubular structure having a second radial wall circumscribing a second axis, the second tubular structure comprising a second terminal end of the tensile-strand reinforcement mechanism and comprising a second slot extending entirely through the second radial wall from an external surface of the second radial wall to an internal surface of the second radial wall, wherein the first tubular structure and the second tubular structure are substantially parallel, and wherein the first slot and the second slot are each positioned proximate the first side of the tensile-strand reinforcement mechanism;

a bent channel connecting the first tubular structure with the second tubular structure, the bent channel having an open side fluidly connecting to the first slot and the second slot, wherein the first slot extends entirely to the first terminal end and the second slot extends entirely to the second terminal end; and a lace passageway having a lace-passageway axis circumscribed by the bent channel, wherein the lace-passageway axis of the lace passageway bisects the tensile-strand reinforcement mechanism into the first side and the second side, wherein the lace passageway is open ended directly between the first terminal end and the second terminal end, such that the lace passageway is accessible through an opening between the first terminal end and the second terminal end.

8. The tensile-strand reinforcement mechanism of claim 7, wherein the lace passageway extends from the bent channel entirely to both the first terminal end and the second terminal end.

9. The tensile-strand reinforcement mechanism of claim 7, wherein at least one of the first slot and the second slot is substantially straight.

10. The tensile-strand reinforcement mechanism of claim 7, wherein the first slot extends in a non-straight manner.

11. A footwear article comprising:

a tensile-strand reinforcement mechanism comprising:

a first tubular structure having a first radial wall circumscribing a first axis, wherein the first axis of the first tubular structure bisects the tensile-strand reinforcement mechanism into an open side and a closed side, the first tubular structure comprising a first terminal end of the tensile-strand reinforcement mechanism and comprising a first slot extending entirely through the first radial wall from an external surface of the first radial wall to an internal surface of the first radial wall;

a second tubular structure having a second radial wall circumscribing a second axis, wherein the second axis of the second tubular structure bisects the tensile-strand reinforcement mechanism into the open side and the closed side, the second tubular structure comprising a second terminal end of the tensile-strand reinforcement mechanism and comprising a second slot extending entirely through the second radial wall from an external surface of the second radial wall to an internal surface of the second radial wall, wherein the first tubular structure and the second tubular structure are substantially parallel; and a u-shaped bent channel connecting the first tubular structure with the second tubular structure, the u-shaped bent channel having the open side fluidly connecting to the first slot and the second slot; and a tensile strand configured to pass through the first slot and the second slot to be positioned in the first tubular structure and the second tubular structure, respectively.

12. The footwear article of claim 11, wherein the first slot extends entirely to the first terminal end and the second slot extends entirely to the second terminal end.

13. The footwear article of claim 11, wherein the at least one of the first slot and the second slot is substantially straight.

14. The footwear article of claim 11, wherein the at least one of the first slot and the second slot extends in a non-straight manner.

15. The footwear article of claim 11 further comprising, a lace passageway extending from the u-shaped bent channel entirely to both the first terminal end and the second terminal end.

* * * * *